US008707925B2

(12) United States Patent
Siber et al.

(10) Patent No.: US 8,707,925 B2
(45) Date of Patent: Apr. 29, 2014

(54) AIR INTAKE WITH AIR MASS SENSOR AND SOUND DAMPENING RESONATOR

(75) Inventors: Ralf Siber, Mainz (DE); Burkhard Bode, Osterspai (DE); Wolfgang Fasan, Erbach (DE)

(73) Assignee: GM Global Technology Operations LLC, Detroit, MI (US)

( * ) Notice: Subject to any disclaimer, the term of this patent is extended or adjusted under 35 U.S.C. 154(b) by 285 days.

(21) Appl. No.: 13/253,116

(22) Filed: Oct. 5, 2011

(65) Prior Publication Data

US 2012/0085308 A1 Apr. 12, 2012

(30) Foreign Application Priority Data

Oct. 7, 2010 (DE) ..... 10 2010 047 853

(51) Int. Cl.
*F02M 35/10* (2006.01)

(52) U.S. Cl.
USPC ..... 123/184.57; 181/229

(58) Field of Classification Search
USPC ..... 123/198 E, 184.57; 181/229, 276
See application file for complete search history.

(56) References Cited

U.S. PATENT DOCUMENTS

| | | | | |
|---|---|---|---|---|
| 4,790,864 | A | 12/1988 | Kostun | |
| 5,106,397 | A * | 4/1992 | Jaroszczyk et al. | 181/276 |
| 5,806,480 | A | 9/1998 | Maeda et al. | |
| 2005/0284692 | A1 | 12/2005 | McWilliam et al. | |
| 2008/0264719 | A1 | 10/2008 | Seko et al. | |

FOREIGN PATENT DOCUMENTS

| | | | |
|---|---|---|---|
| DE | 3842248 | A1 | 6/1989 |
| DE | 102008001390 | A1 | 10/2008 |
| DE | 102008016690 | A1 | 10/2009 |

* cited by examiner

*Primary Examiner* — Noah Kamen
(74) *Attorney, Agent, or Firm* — Ingrassia Fisher & Lorenz, P.C.

(57) ABSTRACT

An intake tract is provided for combustion air of a vehicle. The intake tract includes, but is not limited to an intake opening and an intake channel. At the end of the intake channel a sound source is arranged, which is sound-dampened by a sound damping device in the intake channel. An air filter is arranged between part regions of the intake channel and downstream of the air filter an air mass sensor is provided in an intake channel section, wherein the intake channel section of the air mass sensor includes, but is not limited to the sound damping device.

10 Claims, 2 Drawing Sheets

AIR INTAKE WITH AIR MASS SENSOR AND SOUND DAMPENING RESONATOR

CROSS-REFERENCE TO RELATED APPLICATION

This application claims priority to German Patent Application No. 102010047853.9, filed Oct. 7, 2010, which is incorporated herein by reference in its entirety.

TECHNICAL FIELD

The technical field relates to an intake tract of a combustion air of a vehicle. The intake tract comprises an intake opening and an intake channel. At the end of the intake channel a sound source is arranged, which is sound dampened by a sound damping device in the intake channel.

BACKGROUND

From the publication DE 10 2008 001 390 A1 a muffler is known, which is arranged in an intake tract and for damping sound, comprises an inner pipe in which gas flows and an outer pipe which surrounds the inner pipe.

At least one object is to create such an intake tract with muffler device that is spatially constructed more compact. In addition, other objects, desirable features, and characteristics will become apparent from the subsequent summary and detailed description, and the appended claims, taken in conjunction with the accompanying drawings and this background.

SUMMARY

An embodiment comprises an intake tract of a combustion air of a vehicle. The intake tract has an intake opening and an intake channel. At the end of the intake channel a sound source is arranged, which is sound dampened by a sound damping device in the intake channel. An air filter is arranged between part regions of the intake channel and downstream of the air filter an air mass sensor is provided in an intake channel section, wherein the intake channel section of the air mass sensor comprises the sound damping device.

An advantage of this intake tract is that it is constructed shorter than conventional intake tracts since the sound damping device is integrated in the intake tract without additional space requirement. In addition, the measurements of the air mass sensor are not distorted through interference noises.

In an embodiment, the sound damping device comprises at least one sound-damping resonator coaxially adapted to the intake channel section. Such a sound damping resonator has the advantage that it does not impair the air mass measuring element arranged in the center of the intake channel section and thus neither the air mass measurement. The combustion air stream can flow through the intake channel section previously provided for such measurements in an unhindered manner wherein it is known that for such measurements a diameter of the intake channel section is provided, which is adapted to the airflow and that the length of the required measuring pipe for the air mass measurement is a multiple, but at least 1.5 times the inner diameter of the intake channel section. These lengths can now be utilized in advantageous manner for dimensioning the sound damping resonator adapted to the intake channel section, so that extension sections of the intake tract for sound damping can be saved, which reduces the weight and space requirement of the intake tract.

Here, a radial coupling slit of the sound damping resonator forms a kind of open flow valve that is dependent on the flow direction. This means that the intake flow can flow through in direction of the combustion engine in a practically unhindered manner, while the sound pressure waves, which spread opposite to the intake flow since the sound source is arranged at the end of the intake channel, can be captured and compensated through the radial coupling slit of the sound-damping resonator. Thus, they no longer interfere with the air mass measuring operation of the air mass sensor either.

In order to form such an open flow valve, the coupling slit is provided between an inner radial lip and an inner radial bead arranged downstream of the lip. Here, axial orientations and cross sections of the radial lip and of the radial bead are determined by the coupling direction of the sound damping resonator. In the one flow direction downstream in the intake channel section the radial lip directs the intake flow over the radial bead in an unhindered manner, while in the opposite direction the sound waves after the radial bead are coupled into the radial slit of the sound damping resonator by the radial lip and through adapting the resonator length to the sound wave length to be absorbed, these are dampened.

The coaxially oriented sound damping resonator is formed by a resonator gap that is arranged upstream of the coupling slit so that it can only absorb the re-coupled pressure waves through the sound source and does not influence the flow direction of the intake stream. In order to dampen a wide frequency spectrum, the resonator gap has sound damping resonator regions of different lengths arranged distributed over the circumference, wherein the maximum length and thus the lowest sound frequency that can be dampened, is limited by the length of the intake channel section that is required for the air measurement.

As already mentioned above, a length of the intake channel section for the air mass measurement corresponding to approximately five times the inner diameter would be optimal. For space reasons, however, air mass sensors in combustion engine construction are inserted in an intake channel section, the lengths of which approximately corresponds to only twice the diameter.

This length is still sufficient in order to arrange a wide-band sound-damping device with different resonator length in the radial gap and thus absorb or dampen sound frequencies between approximately 0.5 kHz≤f≤approximately 2.5 kHz. To this end, a length l of the sound damping device between approximately 50 mm≤l≤approximately 150 mm is employed. The inner diameter of the intake channel section of the air mass sensor however is primarily determined by the volumetric flow of the combustion air that is to be conveyed through the intake channel and usually has a minimum diameter of at least approximately 50 mm.

The sound source, which produces such sound waves that spread against the flow direction, is a turbocharger downstream of the intake channel section, with which the sucked-in combustion air is compressed to a charge pressure before it is admitted into the combustion engine.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or the following detailed description.

Figure 1:
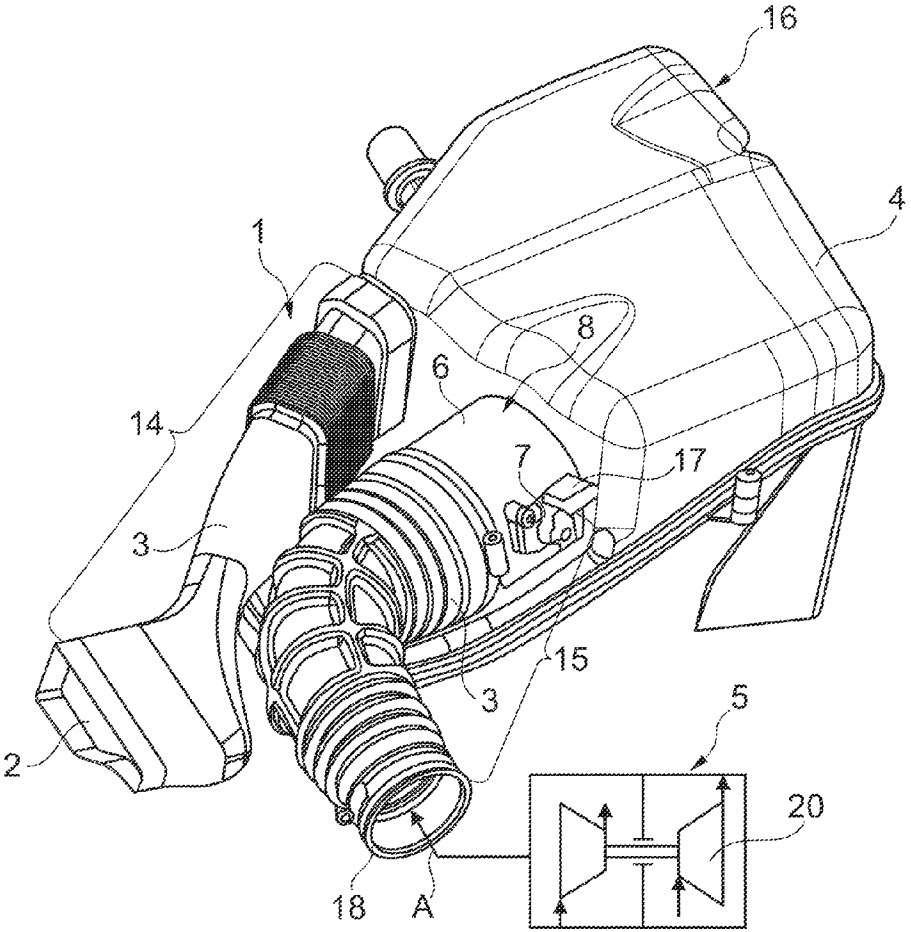
FIG. 1 shows a schematic view of an intake tract according to an embodiment.

FIG. 1 shows a schematic view of an intake tract 1 according to an embodiment. The intake tract 1 comprises an intake opening 2 and an intake channel 3, wherein the intake channel 3 consists of a first part region 14 and a second part region 15. Between the first part region 14 and the second part region 15 a damping filter box 16 is arranged, which comprises an air filter 4 and simultaneously exhibits a muffler effect.

The second part region 15 is arranged downstream of the air filter 4 and comprises an air mass sensor 7 in an intake channel section 6, which is arranged in an axial center of the tubular intake channel section 6 and whose signals are fed to an engine control unit which is not shown via a connecting element 17. At an end 18 of the intake channel 3 which is not shown here a turbocharger 20 is connected, which as sound source 5 generates sound waves that spread against the flow direction in the direction of the arrow A. These pressure differentials in the form of sound waves spreading against the flow direction would impair the measurement result of the air mass sensor, so that the sound damping device 8 usually is to be arranged downstream of the air mass sensor with respect to the combustion airflow.

Figure 2:
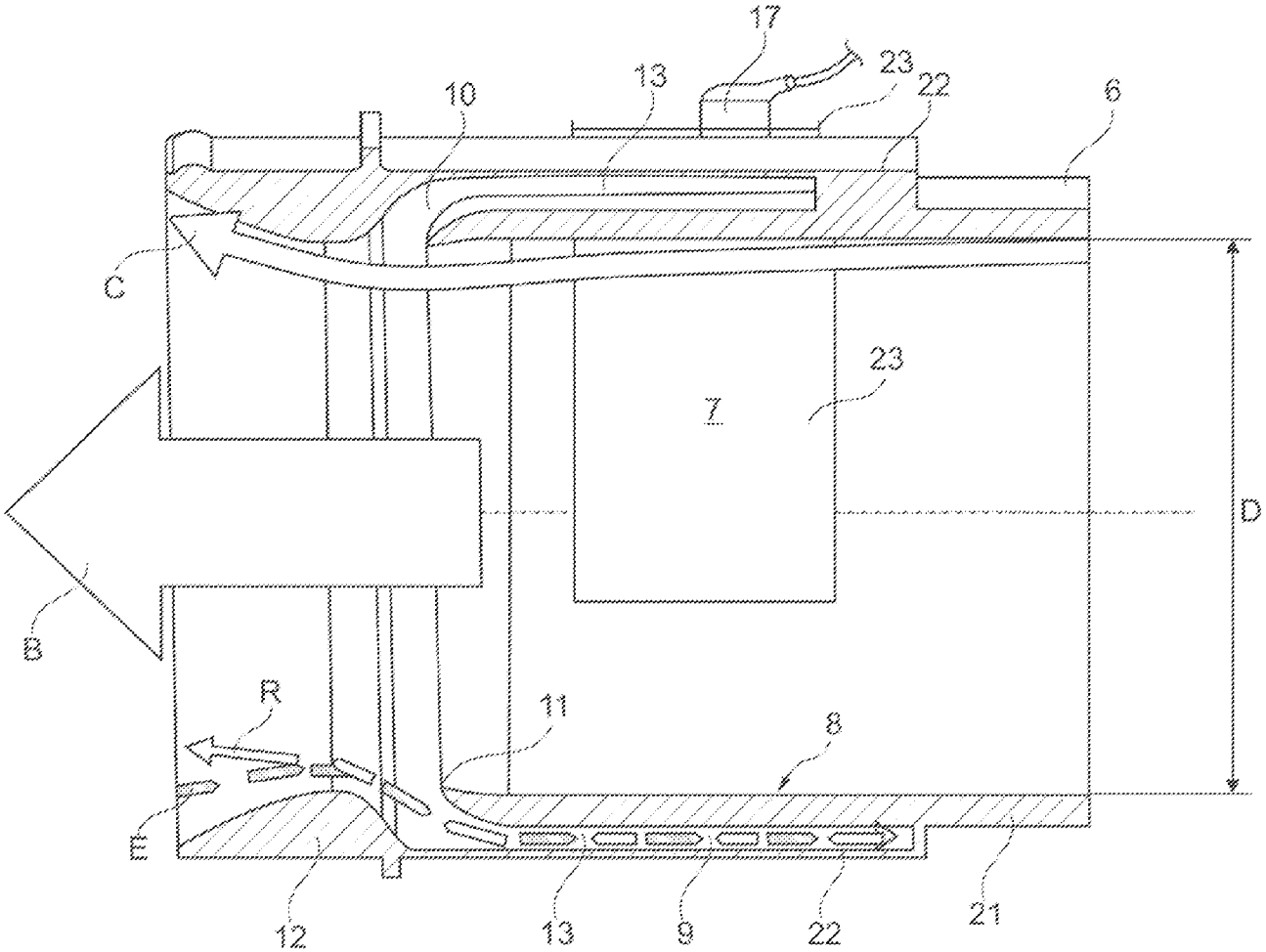
FIG. 2 shows a schematic cross section through an intake channel section of the intake tract according to FIG. 1.

FIG. 2 shows a schematic cross section through an intake channel section 6 of the second part region 15 of the intake channel 3, as it is shown in FIG. 1. In its center, the intake channel section 6 comprises a measuring nozzle 23 of the air mass sensor 7. The measurement signals are transmitted to an engine control that is not shown via a connecting element 17. For the measurement, an inner diameter of the intake channel section is required which depends on the flow direction and the flow rate and is configured in such a manner that the flow in arrow direction B is a laminar flow through the intake channel section 6 as illustrated by the arrow C and does not form any turbulences.

Accordingly, for coupling a sound damping resonator 9, which is arranged between an inner pipe 21 and an outer pipe 22 and comprises a resonator gap 13 between the two pipes, a coupling slit 10 is provided downstream of the air mass sensor 7. In order to guide the combustion airflow in operating direction, which is shown by the arrow B, past the radial coupling slit 10 in arrow direction C, the inner pipe 21 forms a lip 11, while the outer pipe 22 downstream of the radial coupling slit 10 comprises a bead 12.

The radial lip 11 ensures that the sound waves of the sound source spreading against the operating direction in arrow direction E are directed into the coupling slit 10. The resonator gap 13, which has a ¼ of a sound wave length, reflects the sound wave, wherein the sound wave reflected in arrow direction R is superimposed on the coupled-in sound wave and decoupled-in sound wave and the reflected sound wave extinguish each other in the ideal case, but at least mutually weaken each other. Here, the length of the resonator gap 13 can vary over the circumference of the outer pipe 22 continuously or in steps in order to achieve as wide a band of sound damping as possible through the resonator gap 13.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. An intake tract for combustion air of a vehicle, comprising:

an intake opening;

an intake channel;

a sound source arranged at an end of the intake channel;

a sound damping device in the intake channel that is configured to sound-dampen the sound source;

an air filter arranged between part regions of the intake channel; and an air mass sensor downstream of the air filter and arranged in an intake channel section, wherein the intake channel section of the air mass sensor comprises the sound damping device, wherein the sound damping device comprises a sound damping resonator coaxially configured to the intake channel section, wherein a radial coupling slit of the sound damping resonator is a flow direction-dependent open flow valve, wherein the radial coupling slit is arranged between an inner radial lip and an inner radial bead and downstream of the inner radial lip, and wherein axial orientations and cross sections of the inner radial lip and the inner radial bead determine a coupling direction of the sound damping resonator.

2. The intake tract according to claim 1, wherein a coaxially oriented resonator gap is arranged upstream of the radial coupling slit.

3. An intake tract, for combustion air of a vehicle, comprising:

an intake opening;

an intake channel;

a sound damping device in the intake channel that is configured to sound-dampen a sound source;

an air filter arranged between part regions of the intake channel; and an air mass sensor downstream of the air filter and arranged in an intake channel section, wherein the intake channel section of the air mass sensor comprises the sound damping device, wherein a coaxially oriented resonator gap is arranged upstream of the radial coupling slit, wherein the sound damping device comprises a sound damping resonator coaxially configured to the intake channel section, and wherein the coaxially oriented resonator gap comprises sound damping resonator regions of different lengths that are distributed over a circumference.

4. The intake tract according to claim 1, wherein an overall length of the intake channel section of the air mass sensor corresponds to at least twice an inner diameter of the intake channel section.

5. The intake tract according to claim 1, wherein the sound damping device is provided in a wide-band manner for sound frequencies between approximately 0.5 kHz≤f≤approximately 2.5 kHz.

6. The intake tract according to claim 1, wherein a length of the sound damping device is provided between approximately 50 mm≤l≤approximately 150 mm.

7. The intake tract according to claim 1, wherein an inner diameter of the intake channel section of the air mass sensor is configured to a volumetric flow of the combustion air through the intake channel.

8. The intake tract according to claim 1, wherein the sound source is a turbocharger arranged downstream of the intake channel section of the air mass sensor.

9. An intake tract for combustion air of a vehicle, comprising:

an intake opening;

an intake channel;

a sound damping device in the intake channel that is configured to sound-dampen a sound source;

an air filter arranged between part regions of the intake channel; and an air mass sensor downstream of the air filter and arranged in an intake channel section, wherein the intake channel section of the air mass sensor comprises the sound damping device, wherein the sound damping device comprises a sound damping resonator coaxially configured to the intake channel section, wherein the sound damping resonator includes a radial coupling slit arranged between an inner radial lip and an inner radial bead and downstream of the inner radial lip.

10. An intake tract for combustion air of a vehicle according to claim 9, wherein axial orientations and cross sections of the inner radial lip and the inner radial bead determine a coupling direction of the sound damping resonator.

* * * * *